US006848380B1

(12) United States Patent
Sainz

(10) Patent No.: US 6,848,380 B1
(45) Date of Patent: Feb. 1, 2005

(54) FLOATABLE VESSEL LIFT

(76) Inventor: Jorge R. Sainz, 2012 NE. 122$^{nd}$ Rd., North Miami, FL (US) 33181

( * ) Notice: Subject to any disclaimer, the term of this patent is extended or adjusted under 35 U.S.C. 154(b) by 0 days.

(21) Appl. No.: 10/605,724

(22) Filed: Oct. 22, 2003

(51) Int. Cl.$^{7}$ ..... B63C 1/00
(52) U.S. Cl. ..... 114/49; 403/3
(58) Field of Search ..... 114/263, 44, 45, 114/49, 53; 405/3

(56) References Cited

U.S. PATENT DOCUMENTS 4,018,179 A * 4/1977 Rutter ..... 114/45
4,864,951 A * 9/1989 Koepp, Jr. ..... 114/44
5,002,000 A 3/1991 Rutter
5,131,342 A 7/1992 Sackett
5,860,379 A 1/1999 Moody
5,947,050 A * 9/1999 Eva et al. ..... 114/263

* cited by examiner

*Primary Examiner*—Sherman Basinger
(74) *Attorney, Agent, or Firm*—Malin, Haley & DiMaggio, P.A.

(57) ABSTRACT

The present invention relates to a floatable vessel lift comprising: at least two pontoon chambers, where each of the at least two pontoon chambers includes a top housing and a base. The pontoon's top housing has an arcuate longitudinal surface and the base side is substantially flat. Support members horizontally join the at least two pontoon chambers to support a vessel during the lifting process. A user varies the submersion of the vessel lift during use by using a single air infusion device that introduces an air flow into the at least two pontoon chambers simultaneously.

7 Claims, 3 Drawing Sheets

FLOATABLE VESSEL LIFT

BACKGROUND OF INVENTION

1. Field of the Invention

The present invention relates to a floating device for lifting a vessel such as a motor boat typically sized from 19 feet to 39 feet from a body of water when the vessel is not in use, providing dry storage.

2. Description of Related Art

Many docking techniques are available to boat users for boat removal and insertion into a body of water. One method involves the tying of the boat to a dock and implementing the use of a hoist lift system to remove and insert the subject boat. Usually, these hoist systems require the use of a davit, pulleys, cables and winches in various and normally complex configurations. The hoist lift systems usually include the use of a permanent dry dock in conjunction with the hoist system. Accordingly, the hoist systems normally lack any portability. Hoist systems can also be costly to install and maintain and a user normally needs to constantly monitor the height of the boat if left hoisted to adjust to the changing water levels. Davits are permanent and interfere with other uses of the dock.

An alternative to the mechanical hoist type lift would be the use of pontoons that may surround and support the vessel above the water while the pontoons are in water. Pontoons have the ability to automatically adjust to changes in the water level; however, pontoons may not provide the stability needed to support the vessel absent the use of extensive mechanical connections to the dock. The pontoons may sink and rise with water level, however, most pontoons for boatlifting are expensive and fail to provide independent even stable support for the subject vessel.

U.S. Pat. No. 5,860,379 to Moody (Moody) relates to an inflatable floating boatlift device that includes main air chambers and a network of hoses and valves connected to a blower that controls the inflation and deflation of each main chamber. The boatlift of Moody may provide a device to lift a vessel, however, the device requires a complex system of hoses and ropes for attachment to a dock.

U.S. Pat. No. 5,131,342 to Sackett (Sackett) relates to a boatlift including two pontoon chambers engaged to a boat hull engaging member by a lifting member connected there between. The boatlift of Sackett includes lifting members that are adapted to raise and lower the boat hull-engaging member with respect to the pontoon chambers where the pontoon chambers are adapted to buoyantly support both the boat hull engaging member and the lifting member. The floatation device of Sackett may lack sufficient stability to function according to the user's needs.

U.S. Pat. No. 5,002,000 to Rutter (Rutter) relates to a boatlift and leveler where the boatlift consists of a cradle supported by at least two pontoons laterally disposed beneath and fixed to the cradle. The pontoons of Rutter have a water vent through their rear lower surface and an air vent through their forward upper surface so that the rear portions of the pontoons and cradle will tend to be more submerged that the forward portions. The pontoons of Rutter require the use of additional mechanical equipment in order to function in an appropriate manner.

Accordingly a need exists to provide a mobile, low cost and efficient method of boatlifting. A need also exists to provide a boatlifting device that provides a stable, even and yet uncomplicated method of boatlifting.

SUMMARY OF INVENTION

The present invention addresses some of the shortcomings of the prior art by providing a stable, portable and floatable vessel lift for dry vessel storage. The most sinkable vessels are motor boats from 20 feet to around 40 feet. The present invention utilizes rigid dynamically floatable pontoon chambers, which enable the boat lift to float evenly during use. Since the present invention floats, water transport is feasible. Furthermore, the present invention does not require the use of extensive cables or hoists during operation. The pontoon chambers used with a low pressure air supply and valve allow the user to vary the depth of the lift's submersion evenly. Once the user maneuvers the lift completely level under the subject vessel, the user increases the air volume within the pontoon chambers in order to cause the lift and the vessel to immerge out of the body of water evenly.

The present invention relates to a floatable vessel lift comprising: at least two pontoon chambers, where each of the at least two pontoon chambers includes an upper housing and a base, where the upper housing has an arcuate longitudinal surface and the base side is substantially flat; at least two vessel support members, where the least two support members horizontally join the at least two pontoon chambers; and an air infusion device and air control valve where said air infusion device provides a controllable air supply to introduce an air flow into the at least two pontoon chambers to change ballast evenly.

The present invention also relates to a method of lifting a vessel out of the water for dry storage comprising the steps of: placing a vessel lift into a body of water; submerging the vessel lift and changing the water line relative to two vessel supports attached to said pontoons and allowing the influx of water into at least two pontoons having upper arcuate shaped air chambers; positioning a vessel above said vessel supports between at least two guides, where said at least two guides extend vertically from the vessel lift; infusioning air into the at least two pontoon chambers simultaneously; controlling the elevation evenly of the vessel lift by controlling the air flow into the pontoon chambers and increasing the buoyancy of the lift evenly until the vessel is supported above the water.

In accordance with these and other objects which will become apparent hereinafter, the instant invention will now be described with particular reference to the accompanying drawings.

DETAILED DESCRIPTION

Figure 1:
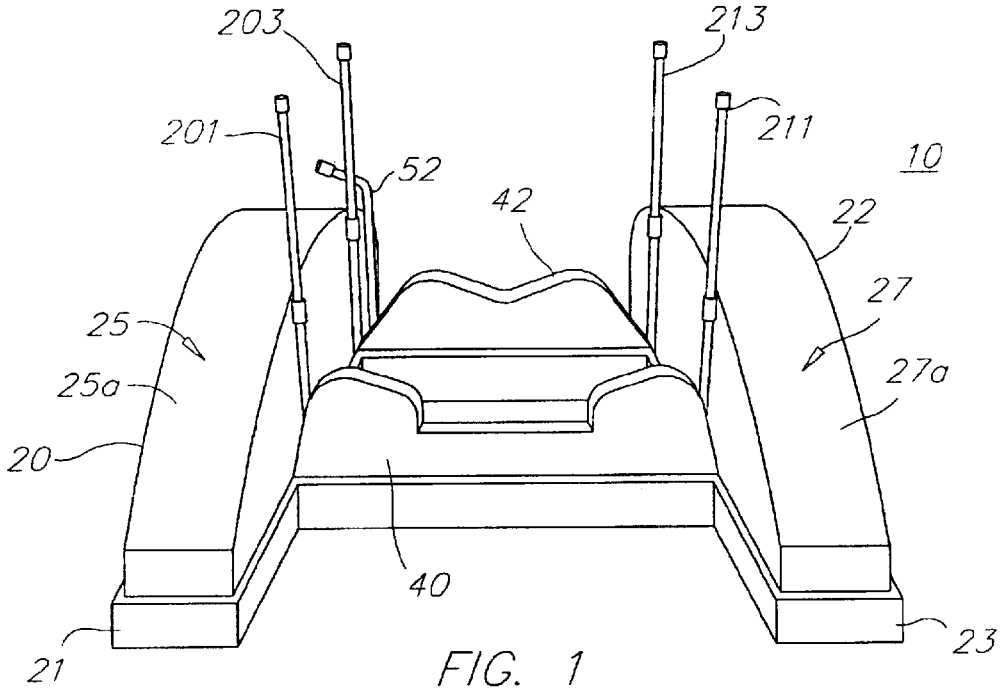
FIG. 1 shows a perspective view of the present invention.

The present invention shown in FIG. 1 relates to a floatable vessel lift that provides a stable and portable device to lift a vessel evenly in a body of water. The floatable vessel lift 10 enables the user to lift a vessel evenly from the water for dry storage on at least two vessel support cross members 40 and 42 adjoined to floatable parallel pontoon chambers 25 and 27. The pontoon chambers 25 and 27 and vessel support members 40 and 42 are substantially submerged while the subject vessel (not shown) is positioned over the support cross members 40 and 42 in a longitudinally balanced and laterally symmetrically balanced position. In order to create the desired buoyancy or lift, the user inserts a single source of air into pipe 52 under pressure into the rigid air impermeable pontoon chambers causing the displacement of water within the pontoon chambers through apertures in the bottom of each pontoon chamber. As the volume of air increases in the pontoon chambers 25 and 27 and the volume of water decreases, the buoyancy or lift, and consequently, the subject vessel rises upwardly relative to the body of water evenly. Due to the arcuate configuration of the top surface of pontoon chambers 25 and 27 and implementation of buoyant stabilizing devices mounted inside each pontoon, the present invention provides a stable, evenly maintainable dynamic floatable vessel lift at all stages.

FIG. 1 shows an exemplary embodiment of a floatable boatlift 10 according to the present invention. The floatable vessel lift 10 includes at least two parallel pontoon chambers, a first pontoon chamber 25 and a second pontoon chamber 27. The pontoon chambers 25 and 27 provide a system for the boat lift 10 to (adjustably) maintain buoyancy evenly floating in the water. The pontoon chambers 25 and 27 include rigid bases 21 and 23 and air impermeable top housings 20 and 21. The pontoon tops 20 and 22 are arcuately shaped along the top longitudinal surfaces 25*a* and 27*a* and substantially flat along the bases 21 and 23. The pontoon housings 25 and 27 have advantageously arcuate top surfaces 25*a* and 27*a* that enable the floatable lift 10 to function with an even lateral and longitudinal stability and superior control of buoyancy with internal water variation. The free surface effect of water inside each pontoon is significantly reduced by the arcuate shape. The pontoon top housings 20 and 22 are permanently sealed and attached to the pontoon bases 21 and 23. The pontoon chambers 25 and 27 provide a stable buoyancy platform adjustable for supporting a vessel and floatable lift 10 evenly while in operation. The pontoon chambers 25 and 27 are filled with water and air. The volume of water (and volume of air) can be varied in order to vary the depth of submersion of the floatation lift 10 to raise (or lower) a supported vessel above the water line.

Figure 2A:
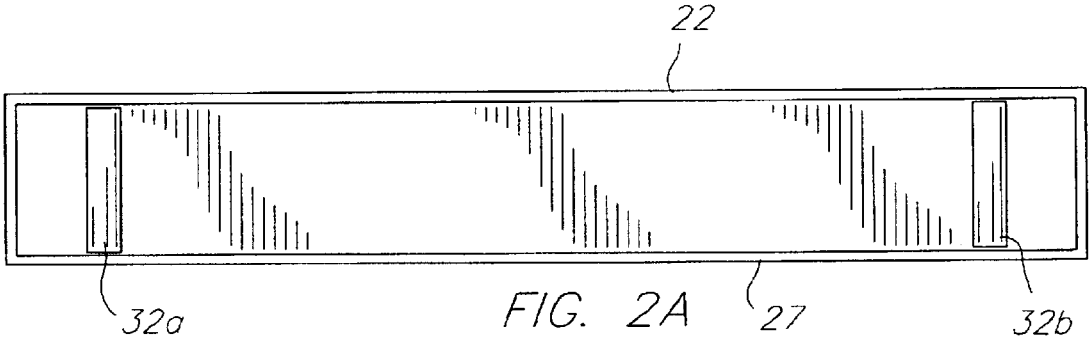
FIG. 2A shows a bottom plan view of the interior of a pontoon housing top.
Figure 2B:
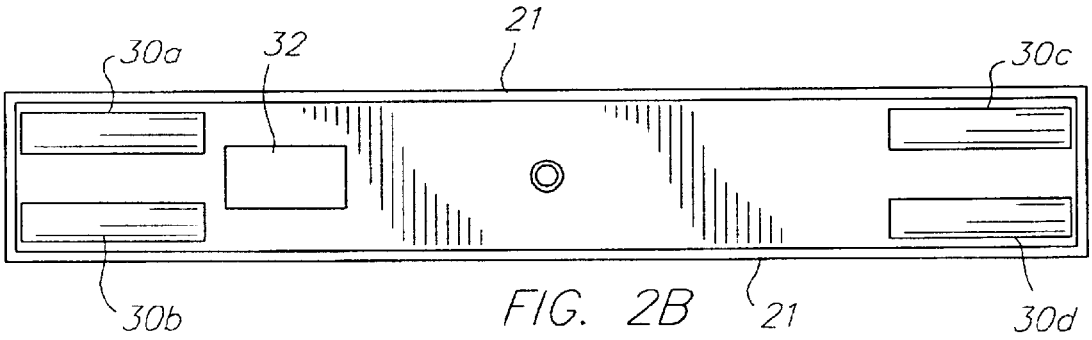
FIG. 2B shows a top plan view of the interior of a pontoon base.

Stabilization members 30*a* through 30*d* and 32*a* and 32*b* (FIGS. 2A and 2B) are air tight sealed void tubes mounted in base 21. Stabilization members 32*a* and 32*b* are lodged within the pontoon top housings 20 as shown in FIG. 2A. Referring to FIG. 2B, an embodiment of the base 21 is shown that includes stabilization members 30*a*, 30*b*, 30*c* and 30*d*. During use, the stabilization members 30*a*, 30*b*, 30*c* and 30*d* provide additional buoyancy within the pontoon chambers 25 and 27 and provide a system for stabilizing the lift 10 during use. Each base 21, 23 includes stabilization members 30*a* through 30*d* that provide sealed tubes with air to increase the stability of the lift 10. The stabilization members 30*a* through 30*d* remain suspended and fixed within the respective pontoon chambers 25 and 27 while the chambers are partially filled with water and submerged evenly in the respective body of water. The four stabilization members 30*a* through 30*d* and cross members 32*a*, 32*b* advantageously increase the overall stability of the lift 10 during all operational modes.

Figure 2C:
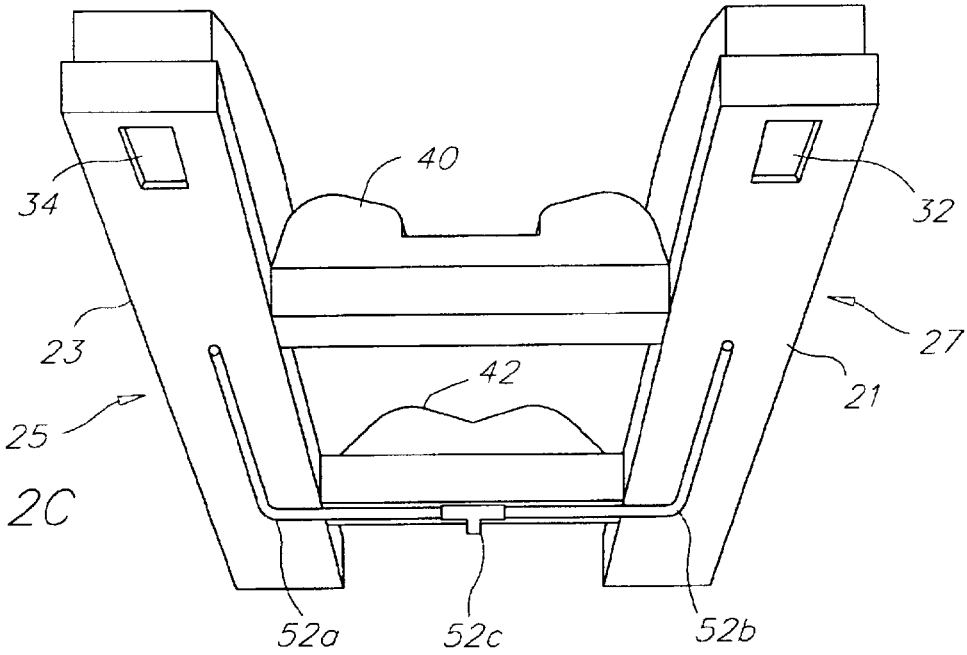
FIG. 2C shows a bottom perspective view of the floatation lift according to the present invention.

While the floatable lift 10 floats in the water, the buoyancy or water level of the lift can be varied simultaneously to each pontoon together in order to lower or raise the height of the floatable lift 10 above the water line by controlled air under pressure and a control air valve. Allowing ambient water to enter the pontoon chambers 25 and 27 by changing the air pressure internally causes the floatable lift 10 to lower and submerge evenly deeper into the water. Conversely, air under pressure may be supplied into each chamber by a single source of air together that consequently causes the internal water to flow out of the chambers 25 and 27 evenly and thus raise the level of submersion of the floatation lift 10 evenly. FIG. 2C shows the pontoon base water transfer openings 32 and 34 on the under side of the lift 10. The base openings 32 and 34 enable the flow of water in and out of the pontoon chambers 25 and 27 based on the air pressure inside each pontoon.

As shown in FIG. 2C, the floatation lift 10 also includes two boat or vessel support members 40, 42. The support members 40, 42 are fixably laterally attached to both pontoon bases 21, 23. The vessel support members 40, 42 structurally connect the pontoons 25 and 27 and engage and vertically support a subject vessel (not shown) the ambient water during operation.

Initially, the boat lift 10 is floating in a body of water such as a lake, ocean or river. The desired level of submergence may then be adjusted accordingly by changing the water level within the pontoon chambers 25 and 27 to increase or decrease the degree of submergence by controlling the air pressure in the pontoon chambers. The water levels within the pontoon chambers are increased simultaneously in order to increase the submergence of the floatation lift 10. The substantially submerged floatation lift 10 may therefore readily receive a subject vessel that may be positionably weight balanced above the support members 40, 42. The support members 40, 42 may be configured to support a bow portion, bow support member 42 and a stern portion, stern support member 40, of the vessel. Moveable thin pole guides 201, 203, 211 and 213 (FIG. 1) are rotatably mounted on the inner surface of support members 40 and 42. The pole guides are vertical while the lift 10 is submerged and provides the user in a boat or vessel with a visible line up guide for directing a vessel over and onto the lift 10 to find a balance location. Once the user has positioned and secured the subject vessel over the support members 40 and 42, the user may then turn on an air supply such as a blower or fan 54 to provide air under pressure through air control valve 58 into the pontoon chambers 25 and 27 through a single source of air 52. The flow of air under low pressure into the pontoon chambers 25 and 27 causes the displacement of water within the pontoon chambers 25 and 27 to be forced out the bottom apertures 32 and 34 and consequently increase the floatation or decrease the submergence level of the floatation lift 10. The decreased submergence level of the floatation lift 10 lifts the vessel from the water evenly and places the floatation lift 10 in the lift mode. Air under pressure is trapped in the pontoons by closing air control valve 58 during the lift mode. While in the lift mode, the vessel rests out of water upon the support members 40 and 42. The pole guides 201, 203, 211 and 213 may be manually rotated into a horizontal stored position. The floatation lift 10 allows a user to maneuver the raised vessel by the floatable lift 10. Furthermore, the user may store the subject vessel dry on the floatation lift 10 and easily insert the vessel back into the water when desired.

Figure 3A:
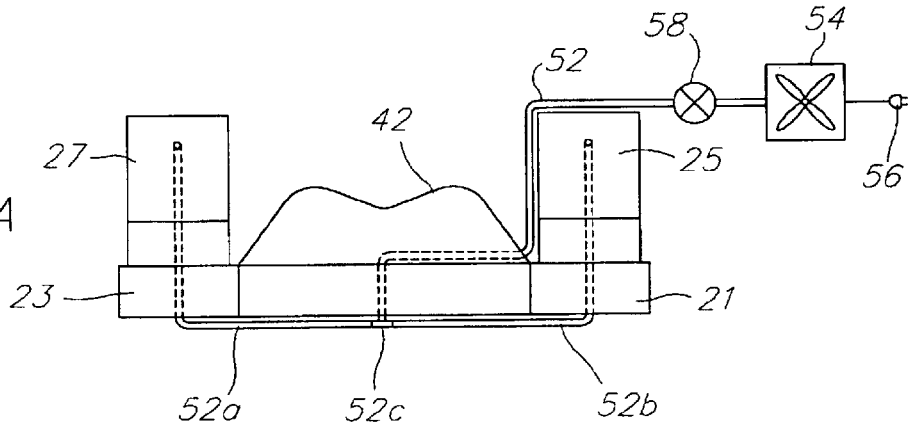
FIG. 3A shows a front elevational view of a bow support member according to the present invention.
Figure 3B:
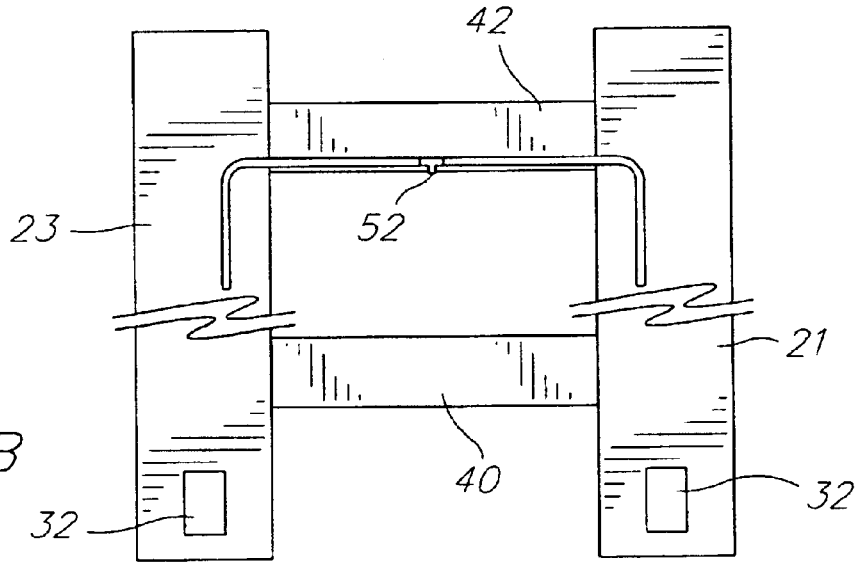
FIG. 3B shows a bottom plan view of the bottom of the boat lift according to the present invention.
Figure 4:
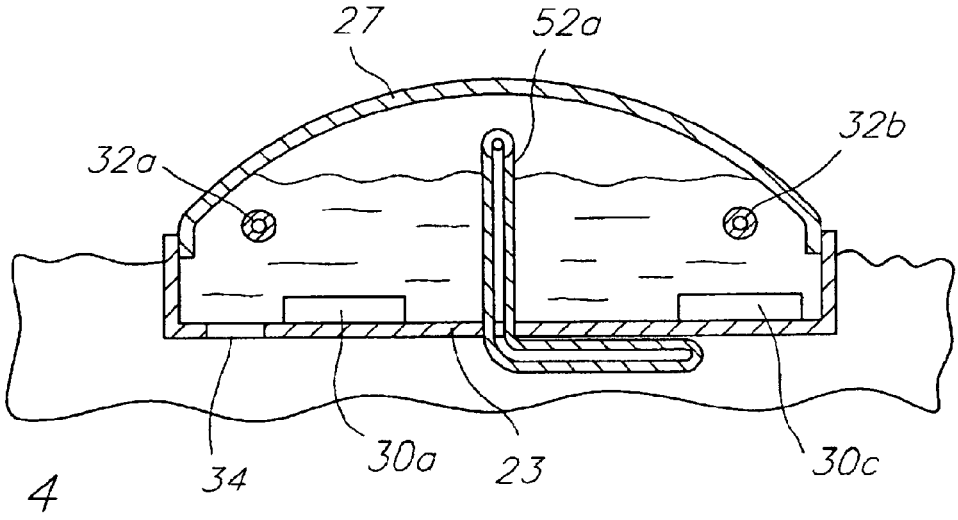
FIG. 4 is a side elevational view in cross section of one pontoon.

A single source of air under pressure comes from blower 54 and electric power source 56, through air infusion tubing 52 shown in FIGS. 3A and 3B. A single air source tube 52 is connected to an air supply 54 under pressure which could be low (2 pounds above atmosphere). The tubing 52 extends above the top of the port (or starboard) side pontoon chamber 25 for accessibility by user. The single tube 52 travels downward on the inside face of the pontoon chamber 25 (or 27) and connects into a T shaped pipe member 52*c* having tubes 52*a* and 52*b* that proceed into the pontoon chamber bases 23 and 21 respectively at the bottom sides. The air infusion tubing 52 provides a pathway for forcing air under pressure into each chamber 25 and 27 simultaneously. The air infusion tubing 52 splits into the T shaped pipe member 52*c* on the under side of the bow support member 42. The air infusion tubes 52*a* and 52*b* extend vertically into the pontoon chambers 25 and 27 through the bottom of each respective pontoon base 21 and 23 and have openings near the arcuate top surfaces (inside) of the pontoons. The infusion of air under pressure displaces water within the pontoon chambers 25 and 27 and consequently causes the floatation lift 10 to be raised relative to the water level. After the vessel is in place over the lift 10 and between guides 201, 203, 211 and 213, then the user connects an air supply 54 onto the receiving end of the air infusion tube 52. Air from the pump or fan 54 travels through the tube 52 at an acceptable rate (approximately 130 CFM) and pressure in order to cause the displacement of water within the pontoon chambers 25 and 27. As the user infuses the pontoon chambers 25 and 27 with air, the floatation lift 10 lifts with the subject boat resting upon the support members 40, 42. Once the boat is upon the lift 10, the user may manipulate, move or simply dock the lift 10 with the boat resting on the support member 40 and 42 above the water line so that the vessel is dry. Guides 201, 203, 211, 213 collapse to a horizontal resting position while the lift 10 and subject boat immerge from the water. The air infusion tube 52 may be sealed by control valve 58 in order to maintain a floating position for the lift 10. The air under pressure in each pontoon is maintained by the control valve 58.

The system is especially suited for motor boats from 20 feet to 39 feet, inboard or outboard having conventional drafts. To reduce the water line to re-float a supported vessel, the control valve is opened to allow ambient water into the pontoons reducing buoyancy.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A floatable vessel lift comprising:

at least two floatable pontoon chambers, where each of the at least two pontoon chambers includes a cover and a base and a water inlet/outlet, where the cover has an arcuate top longitudinal surface and the base is substantially flat, each chamber having an upper arcuate configuration longitudinally;

at least two support members, where the least two support members horizontally join the at least two pontoon chambers; and a single air infusion device where said air infusion device provides tubing to introduce air flow under pressure into the at least two pontoon chambers to exhaust water ballast.

2. The floatable boatlift according to claim 1, further comprising:

a plurality of stabilization members within each of the at least two pontoon chambers.

3. The floatable boatlift according to claim 1, further comprising:

at least one water flow opening on the base of the pontoon chambers.

4. The floatable boatlift according to claim 1, further comprising:

at least two retractable guides.

5. The floatable boatlift according to claim 1, where one of the at least two support members is adapted to receive a bow portion of the vessel.

6. The floatable boatlift according to claim 1, where one of the at least two support members is adapted to receive a stern portion of the vessel.

7. A method of lifting a vessel comprising the steps of:

placing a vessel lift into a body of water, where the vessel lift includes at least two support members, at least two pontoon chambers and at least guides adjacent to the at least two pontoon chambers;

submerging the vessel lift into the water by allowing the influx of water into at least two pontoon chambers;

positioning a vessel between at least two guides, where said at least two guides extend vertically from the vessel lift;

infusioning air into the at least two pontoon chambers; and controlling the elevation of the vessel lift by controlling the air flow into the pontoon chambers and;

inserting stabilization members into the pontoon chambers, at two different planes or levels.

* * * * *